US007976025B2

(12) United States Patent
Hebden

(10) Patent No.: US 7,976,025 B2
(45) Date of Patent: Jul. 12, 2011

(54) DOMINO ROULETTE

(75) Inventor: Michael Patrick Hebden, Douglas (GB)

(73) Assignee: Waterleaf Limited, Douglas, Isle of Man (GB)

( * ) Notice: Subject to any disclaimer, the term of this patent is extended or adjusted under 35 U.S.C. 154(b) by 293 days.

(21) Appl. No.: 11/417,735

(22) Filed: May 4, 2006

(65) Prior Publication Data

US 2007/0257436 A1 Nov. 8, 2007

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

| | | | | | |
|---|---|---|---|---|---|
| 3,770,269 | A | * | 11/1973 | Elder | 463/18 |
| 4,357,015 | A | * | 11/1982 | Santora et al. | 463/22 |
| 4,359,227 | A | * | 11/1982 | Porciello | 273/268 |
| 4,396,193 | A | * | 8/1983 | Reinhardt et al. | 463/22 |
| 4,530,499 | A | * | 7/1985 | Breslow et al. | 463/9 |
| 4,560,171 | A | * | 12/1985 | Anthony | 273/269 |
| 4,804,185 | A | * | 2/1989 | Noble et al. | 463/11 |
| 5,114,344 | A | * | 5/1992 | Fumagalli et al. | 434/128 |
| 5,259,616 | A | * | 11/1993 | Bergmann | 463/17 |
| 5,445,391 | A | | 8/1995 | Gleason, Jr. | |
| 5,522,595 | A | | 6/1996 | Wong | |
| 5,540,442 | A | * | 7/1996 | Orselli et al. | 463/17 |
| 5,607,159 | A | * | 3/1997 | Bryson | 273/243 |
| 5,768,382 | A | | 6/1998 | Schneier et al. | |
| 5,788,241 | A | | 8/1998 | Ung | |
| 5,791,652 | A | * | 8/1998 | Nielsen | 273/305 |
| 5,857,677 | A | | 1/1999 | Sum Chau | |
| 5,899,458 | A | * | 5/1999 | Moore | 273/292 |
| 5,938,528 | A | * | 8/1999 | Glapion | 463/11 |
| 6,050,569 | A | | 4/2000 | Taylor | |
| 6,059,659 | A | * | 5/2000 | Busch et al. | 463/17 |
| 6,217,022 | B1 | * | 4/2001 | Astaneha | 273/138.1 |
| 6,241,607 | B1 | * | 6/2001 | Payne et al. | 463/20 |
| 6,328,305 | B1 | | 12/2001 | Yuan | |
| 6,406,022 | B1 | * | 6/2002 | Nadibaidze | 273/274 |
| 6,592,457 | B1 | * | 7/2003 | Frohm et al. | 463/16 |

(Continued)

FOREIGN PATENT DOCUMENTS

DE 19944140 3/2001

(Continued)

OTHER PUBLICATIONS www.sirmogames.com/belgium/old/oneball/domino_roulette.htm.*

(Continued)

*Primary Examiner* — Alvin A Hunter
*Assistant Examiner* — Dolores Collins
(74) *Attorney, Agent, or Firm* — McDonnel Boehnen Hulbert & Berghoff, LLP

(57) ABSTRACT

Domino wagering games are disclosed in which a player or players place a wager on which domino will be selected, the domino being selected with a domino roulette style wheel or by being revealed after selection from a boneyard. The wagers are based on a bet type as provided in a bet table that comprises a matrix of dominos arranged in columns and rows with paylines corresponding to particular bet types. The paylines are based on the odds that a first domino will be in a particular group as shown on the bet table.

18 Claims, 7 Drawing Sheets

U.S. PATENT DOCUMENTS

| | | | | |
|---|---|---|---|---|
| 6,644,666 | B1 | 11/2003 | Tamura et al. | |
| 6,659,866 | B2 * | 12/2003 | Choo et al. | 463/17 |
| 6,688,598 | B1 | 2/2004 | Hsi | |
| 6,776,714 | B2 * | 8/2004 | Ungaro et al. | 463/27 |
| 6,800,027 | B2 * | 10/2004 | Giobbi et al. | 463/24 |
| 6,890,255 | B2 * | 5/2005 | Jarvis et al. | 463/17 |
| 6,921,072 | B2 * | 7/2005 | Hughes-Watts | 273/142 E |
| 6,942,218 | B2 * | 9/2005 | Davis et al. | 273/268 |
| 7,182,690 | B2 * | 2/2007 | Giobbi et al. | 463/24 |
| 7,204,488 | B2 * | 4/2007 | Ilievski | 273/143 R |
| 7,491,121 | B2 * | 2/2009 | Seelig et al. | 463/20 |
| 7,585,223 | B2 * | 9/2009 | Iddings et al. | 463/27 |
| 7,731,583 | B2 * | 6/2010 | Seelig et al. | 463/20 |
| 2002/0142844 | A1 | 10/2002 | Kerr | |
| 2003/0073475 | A1 * | 4/2003 | Friedman | 463/11 |
| 2003/0122304 | A1 | 7/2003 | Santini | |
| 2004/0245723 | A1 | 12/2004 | Davis et al. | |
| 2005/0035548 | A1 | 2/2005 | Yoseloff et al. | |
| 2005/0161884 | A1 | 7/2005 | Au-Yeung et al. | |
| 2005/0215307 | A1 * | 9/2005 | Jarvis et al. | 463/17 |
| 2006/0012122 | A1 | 1/2006 | Botzen | |
| 2006/0079331 | A1 | 4/2006 | Moshal | |
| 2006/0119038 | A1 * | 6/2006 | Crotteau | 273/148 R |
| 2006/0244218 | A1 | 11/2006 | Frankel et al. | |
| 2006/0249907 | A1 * | 11/2006 | Wong et al. | 273/292 |
| 2007/0063441 | A1 | 3/2007 | Shetterly | |
| 2007/0082728 | A1 * | 4/2007 | Wilkins et al. | 463/22 |
| 2007/0222152 | A1 | 9/2007 | Smith | |
| 2007/0278738 | A1 * | 12/2007 | Taranino | 273/146 |
| 2008/0018049 | A1 * | 1/2008 | Hebden | 273/292 |
| 2008/0111307 | A1 * | 5/2008 | Flower | 273/292 |
| 2008/0315520 | A1 | 12/2008 | Golad | |

FOREIGN PATENT DOCUMENTS

| | | | |
|---|---|---|---|
| DE | 19952691 | | 5/2001 |
| DE | 19952692 | | 5/2001 |
| EP | 1063622 | | 12/2000 |
| EP | 1120757 | A2 | 5/2001 |
| EP | 1852159 | A2 * | 11/2007 |
| GB | 2191953 | | 12/1987 |
| WO | 9410658 | | 5/1994 |
| WO | 9416416 | | 7/1994 |
| WO | 0154091 | A2 | 7/2001 |
| WO | 0237246 | A2 | 5/2002 |
| WO | 0247042 | A1 | 6/2002 |
| WO | 03021543 | A2 | 3/2003 |
| WO | 03/093921 | | 11/2003 |
| WO | 2004095382 | A1 | 11/2004 |

OTHER PUBLICATIONS

European Search Report (Partial) dated Jul. 24, 2007 from Application No. EP 07251873.

International Search Report from WO 2004/095383.

U.S. Appl. No. 11/458,615, for Domino Blackjack, filed on Jul. 19, 2006.

* cited by examiner

| | | | | | | | | | | | |
|---|---|---|---|---|---|---|---|---|---|---|---|
| 5/5 | 0/2 | 3/6 | 0/4 | 3/4 | 2/4 | 0/0 | 5/6 | 0/3 | 1/6 | 1/1 | 3/3 |
| 2/6 | | | | | | | | | | | 4/4 |
| 0/6 | | | | | | | | | | | 1/3 |
| 6/6 | 2/2 | 1/5 | 1/2 | 4/5 | 1/4 | 0/5 | 4/6 | 2/5 | 0/1 | 3/5 | 2/3 |

DOMINO ROULETTE

FIELD OF TECHNOLOGY

The present invention relates to games of chance and more particularly to domino wagering games. Embodiments of the domino wagering games disclosed include wagering on particular bet types according to odds provided on a bet table. The games involve selecting one or more dominoes and determining if the selected domino(es) fall in the category of the wagered bet type.

BACKGROUND

Dominoes are believed to have originated in China in the $12^{th}$ century, although Egyptian or Arabian origins have also been theorized. Dominoes appeared in Italy in the early eighteenth century, and spread to the rest of Europe throughout the remainder the 1700's, becoming one of the most popular games in both family parlors and pubs.

Several types of domino games exist, including single player solitaires and multi-player games. Domino games are played for fun and for money. Generally, domino games begin with the dominoes spread out face-down on a table. The dominoes are manually moved around to shuffle them, and a particular number of dominoes are drawn by each player to form a hand. The object of most domino games is to be the first to get rid of all the dominoes in the player's hand. Some popular domino games include the Draw Game, the Block Game, Muggings, Matador, Bergen, Mexican Train, Chickenfoot, and Forty-Two.

SUMMARY

Disclosed herein are embodiments of domino games in which players can wager on which domino or group of dominoes will be selected.

In one aspect, a domino wagering game as provided herein comprises: a roulette style wheel having a set of dominoes concentrically arranged thereon; a bet table comprising a domino set arranged in a matrix with columns and rows, wherein each row and column comprises a consecutively ordered series of dominoes; and a wager accepting means. The game can be land based (e.g. played on a gaming table) or played in an electronic gaming format (e.g. on a personal computer). The wager accepting means can be any means by which a player identifies a bet type according to the bet table. For example, if the game is land based, the wager accepting means can be the bet table itself, where a player places a chip or other suitable monetary marker on a particular area of the bet table to signify a bet type. If the game is played in an electronic gaming format, using a virtual wheel and virtual bet table, the player can click on a particular area of the bet table to signify a bet type.

In another aspect, a domino wagering game comprises: a set of dominoes; a bet table comprising a domino set arranged in a matrix with columns and rows, wherein each row and column comprises a consecutively ordered series of dominoes; a boneyard area; a bet zone area; and a wager accepting means. The game can be land based or played in an electronic gaming format. If the game is land based, a gaming table is provided that comprises an area for the boneyard and an area for the bet zone, as well as an area for the bet table. If the game is played in an electronic gaming format, the gaming device can display the area for the boneyard and the area for the bet zone, as well as the area for the bet table. The wager accepting means can be any means by which a player identifies a bet type according to the bet table. For example, if the game is land based, the wager accepting means can be the bet table itself, where a player places a chip or other suitable monetary marker on a particular area of the bet table to signify a bet type. If the game is played in an electronic gaming format, the player can click on a particular area of the bet table to signify a bet type.

In one aspect the method comprises the steps of: receiving from said players a plurality of wagers on a bet type that is indicative of a domino or a group of dominoes; selecting a first domino; and determining if the first domino is within the bet type of any of the players. In one aspect, the dominoes are arranged on a roulette style wheel, and the domino or group of dominoes is selected by a spinning ball on the spinning roulette style wheel.

In one domino game, the first domino is selected by spinning a roulette style wheel that comprises a set of dominoes concentrically arranged around the roulette style wheel. The roulette style wheel can be an actual wheel on a gaming table or a virtual wheel in an electronic gaming machine.

In another domino game, the first domino is revealed to the players after the domino has been selected by a player from a boneyard. The boneyard can be an actual boneyard comprising domino tiles laying face down on a surface, or a virtual boneyard, and wherein a domino tile can be selected by clicking on a domino tile in the virtual boneyard in an electronic gaming machine.

Also provided, is a bet table comprising a domino set arranged in a matrix with columns and rows, wherein each row and column comprises a consecutively ordered series of dominoes. The bet table can be provided, for example, in an electronic gaming machine or on a table. The bet table can be made, for example, on felt, showing a printed layout of dominoes in a particular order, with paylines (i.e. odds of the first domino being in the wagered bet type) printed beside each row, column, or diagonal.

An embodiment also provides a roulette style wheel comprising a set of dominoes concentrically arranged thereon. Any set of dominoes, as described herein, can be arranged on the wheel in any particular order.

Other aspects of the present invention will become apparent from the following detailed description, taken in conjunction with the accompanying drawings, which illustrate, by way of example, certain principles of the embodiments.

DETAILED DESCRIPTION OF CERTAIN PREFERRED EMBODIMENTS

Domino games are provided that may be played as a wagered table game, a video game, a combined table and video game, or as a practice wagering game on a personal computer. Embodiments disclosed encompass at least two categories of domino games, referred to herein as "domino roulette" and "domino reveal."

As used herein, the term "domino" and "dominoes" includes conventional dominoes for playing the embodiments of the present invention. Dominoes are generally provided as tiles, but can also be provided in other forms, such as chips or cards. The dominoes typically include marking indicia (commonly referred to as "dots" or "pips") and two halves defined by a separating line. The dots can be inset on the face of the domino, or painted or otherwise placed on a face of the domino.

Figure 1:
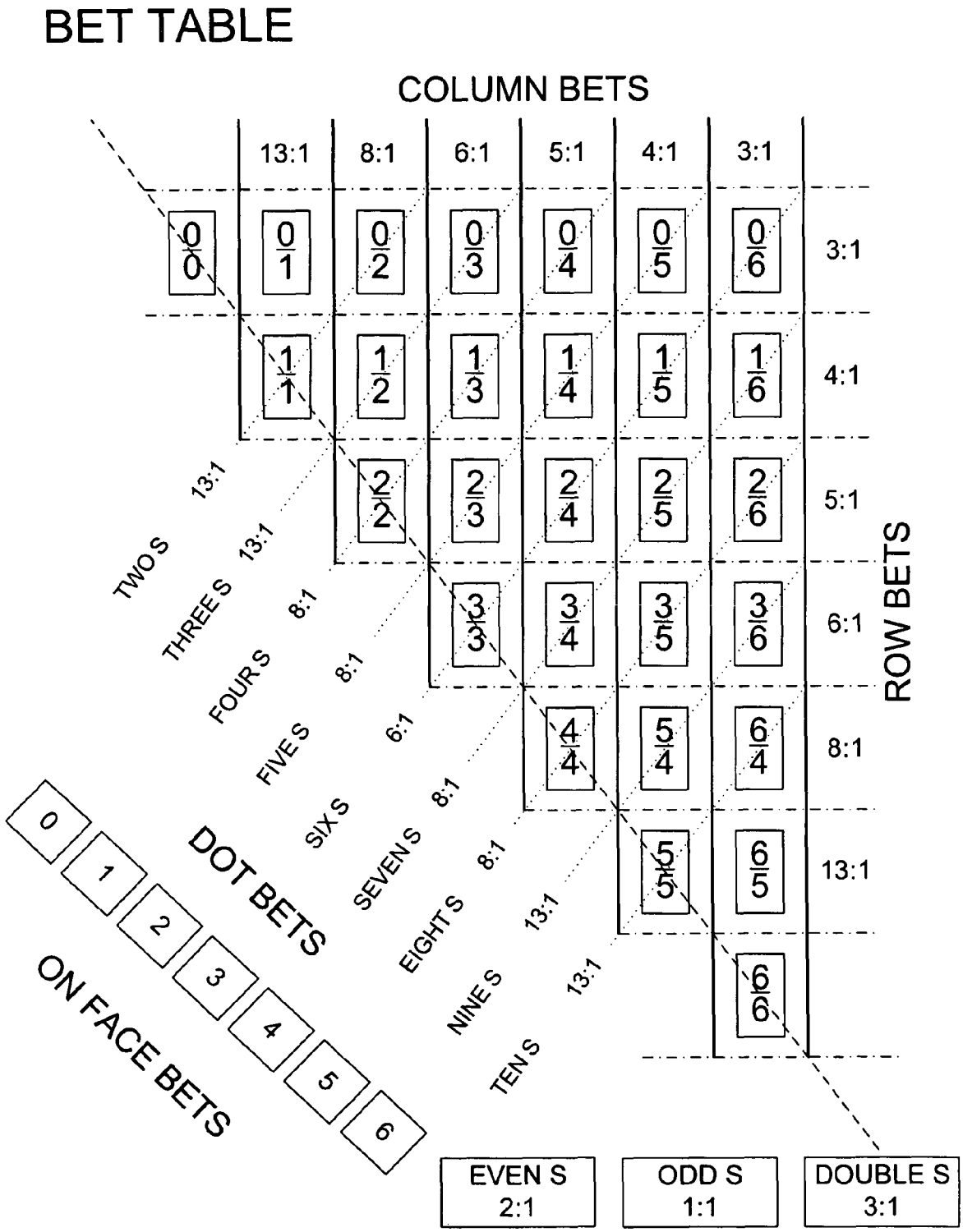
FIG. 1 is an illustration of an exemplary Bet Table with bet types and paylines for domino games of embodiments of the invention.

In one embodiment, the domino games provided herein involve wagering based on a bet table as exemplified in FIG. 1.

FIG. 1 shows a bet table for a standard 28 domino set (i.e. double-six domino set). The bet table shows a betting matrix, which provides the odds that a domino will be selected in the particular groups shown in the columns (Column Bets), rows (Row Bets), and diagonals (Dot Bets). Based on the bet table shown in FIG. 1, various bet types can be made, including, but not limited to, column bets, row bets, dot bets, doubles bets, even and odd bets, tile bets, and on face bets.

Figures 2, 3:
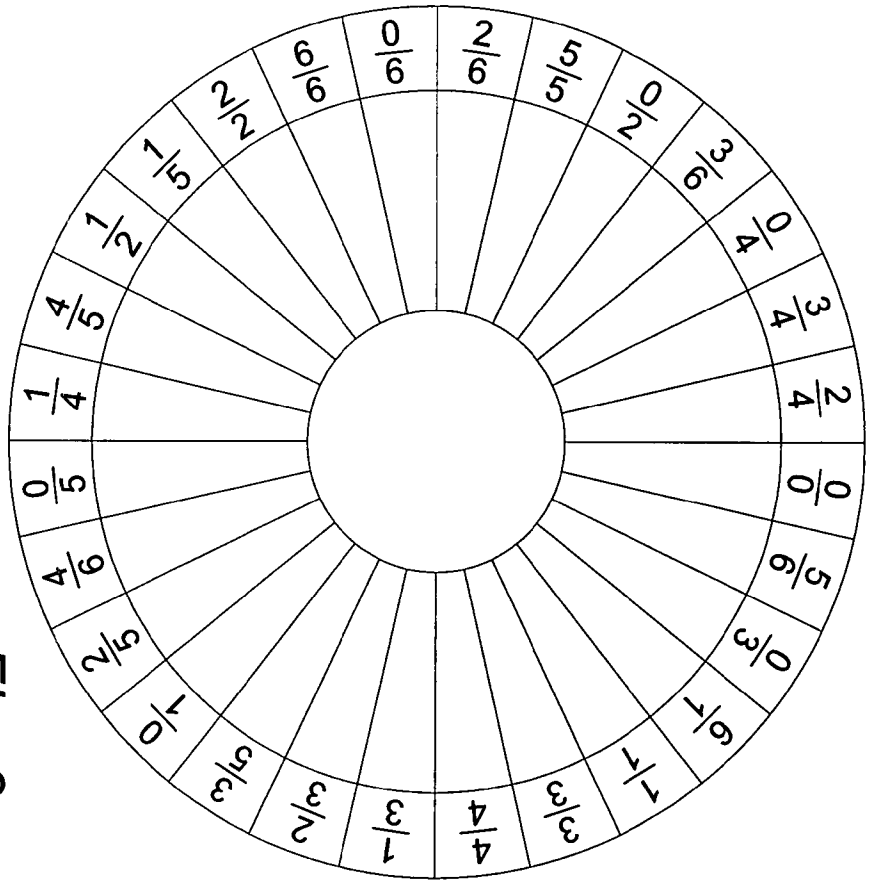
FIG. 2 is an illustration of an exemplary Domino Roulette wheel for use in domino games of embodiments of the invention.
FIG. 3 is an illustration of a betting loop that can be used in the games of embodiments of the invention.

In certain embodiments, a bet table can further (or alternatively) comprise a betting loop (see FIG. 3), that may be similar to a betting loop on the tables of European Roulette Gold. A player can place a wager on a specific domino by placing a chip or other monetary marker on a domino represented on the betting loop. The actual arrangement of dominoes on the betting loop can vary, thus, the arrangement shown in FIG. 3 is exemplary of one arrangement.

In other embodiments, the bet table can further (or alternatively) comprise numbers corresponding to dots on the dominoes for placing Dot Bets as described below. In other embodiments, the bet table may take other forms such as a menu selection. The particular layout of domino markers on the bet table of FIG. 1 is referred to as the triangle layout. Other layouts may be used depending upon the size and shape of the table, number of dominoes used, and other factors.

"Column bets" involve a player betting that the first domino (i.e. the domino selected using the methods described herein) will be in the selected column. According to the embodiment, the numbers of dominoes in each column may vary and so, accordingly, do the available odds. For example, the second column comprises two dominoes, the 0/1 and the 1/1. The true odds that the first domino will be in the second column are 14:1. Thus, a player wagering on the second column may be paid according to the 13:1 payline if the first domino is 0/1 or 1/1—giving the house a systematic advantage.

"Row bets" encompass a player betting that the first domino will be in a selected row. Numbers of dominoes in each column may vary and so, accordingly, do the available odds. For example, the sixth row comprises two dominoes, the 5/5 and the 5/6. The true odds that the first domino will be in the sixth row are 14:1. Thus, a player wagering on the sixth row may be paid according to the 13:1 payline if the first domino is 5/5 or 5/6.

"Dot bets" involve a player betting that the total number of dots on the first domino will equal the selected bet. The dot bets are made according to the diagonal lines in the betting matrix. The numbers of dominoes in each diagonal line vary and so, accordingly, do the available odds. For example, the first diagonal comprises two dominoes, the 0/2 and the 1/1. A player wagering that the first domino will have a total number of dots equal to two will be betting on the first diagonal. The true odds that the first domino will have a total of two dots are 14:1. Thus, a player wagering on the sixth row may be paid according to the 13:1 payline if the first domino has a total of two dots (i.e. the 0/2 or the 1/1 domino). It is noted that the numbers 0, 1, 11, and 12 only have a single tile in the standard double-six domino set, thus the odds are the same as betting directly on that tile.

"Doubles bets" involve the player betting that the first domino will be a double (e.g. 0/0, 1/1, 2/2, 3/3, 4/4, 5/5, or 6/6). The true odds that the first domino will be a double are 4:1. A player wagering on doubles will be paid 3:1 if the first domino is a double.

"Even and odd bets" are accomplished by a player betting that the total number of dots on first domino will either be an even or odd amount. In the standard double-six domino set, 16 of the total 28 dominoes have an even total (including 0/0) and 12 have an odd total. Therefore, the true odds that the first domino will have an even number of dots are 4:7 with a proposed payout of 2:3, and the true odds that the first domino will have an odd number of dots are 3:7 with a proposed payout of 1:1. Thus, a player wagering on evens will be paid 3:2 if the total number of dots on the first domino is an even number, and a player wagering on odds will be paid 1:1 if the total number of dots on the first domino is an odd number. In an alternative embodiment, the 0/0 tile is not included as either even or odd. In yet another embodiment, other tiles may also be provided that are neither even nor odd—these may include "0," "00," or other nonstandard dominoes.

"Tile bets" involve a player betting that the first domino will be a specific domino. For example, a player can wager that the first domino will be a 2/3. The true odds that a specific domino will be selected are 28:1 with a proposed payout of 26:1. Thus, a player wagering on the first domino may be paid 26:1.

"On face bets" involve a player betting that the first domino will comprise a selected number of dots on one half of its face. For example, a player can wager that the first domino will have a five on at least one half (i.e. 0/5, 1/5, 2/5, 3/5, 4/5, 5/5, or 5/6). The true odds that a first domino will have a five on one half are 4:1 with a proposed payout of 3:1. Thus, a player wagering on the first domino may be paid 3:1.

In a particular embodiment, the betting matrix and odds can be changed by changing the make-up of the dominoes. For example, adding dominoes having up to seven dots on one half (i.e. 0/7, 1/7, 2/7, 3/7, 4/7, 5/7, 6/7, and 7/7) to the betting matrix makes the total number of dominoes 36, and the odds will change accordingly. Further, multiple sets of dominoes may be used at once, and/or portions of domino sets. In yet another embodiment, previously selected dominos are removed from the selection pool for the next selection—thus altering the odds.

In other embodiments, a progressive pot is provided, wherein a portion of the gross win is added to a pot to be paid only when a certain criteria is met. For example, an embodiment provides for Dynamite Double Progressive, wherein the progressive pot is paid to a single player when seven consecutive first dominoes have doubles in order from 0/0 to 6/6 (i.e. 0/0, 1/1, 2/2, 3/3, 4/4, 5/5, and 6/6). Alternatively, a Dynamite Double Progressive can be paid when consecutive first dominoes have doubles in order from 0/0 to 5/5, 0/0 to 4/4, 0/0 to 3/3, 0/0 to 2/2, or 0/0 to 1/1. It should be understood that, in a further embodiment, the progressive can begin with any double, not just the 0/0, and that the highest double is not limited to 6/6, but can be whatever highest double is in the domino set being used in the domino game.

Other progressive pots are encompassed herein, including a Run Progressive. For example, a progressive pot can be paid when consecutive first dominoes have consecutive numerical dots. For instance, a Run Progressive is achieved when consecutive first dominoes are 0/6, 1/6, 2/6, 3/6, 4/6, 5/6, and 6/6. A Run Progressive is not limited to dominoes having a six on one half, but can be achieved with any series of dominoes (e.g. 0/1 to 1/1, 0/2 to 2/2, 0/3 to 3/3, 0/4 to 4/4, or 0/5 to 5/5, etc.). The highest number in the Run Progressive is only limited by the highest double in the domino set being used in the domino game.

The bet table described above can be used to wager on the domino games, including "domino roulette" and "domino reveal."

The term "domino roulette" refers to a game that utilizes a roulette style wheel as described below. As in a standard roulette game, a spinning ball on a spinning wheel can be used to "select" a domino. A domino can be selected in this manner after at least one player has placed a wager on which domino or group of dominoes will be selected. Domino roulette can be played by a single player or by multiple players. "Domino roulette" is also referred to herein as "spin mode."

Figure 8:
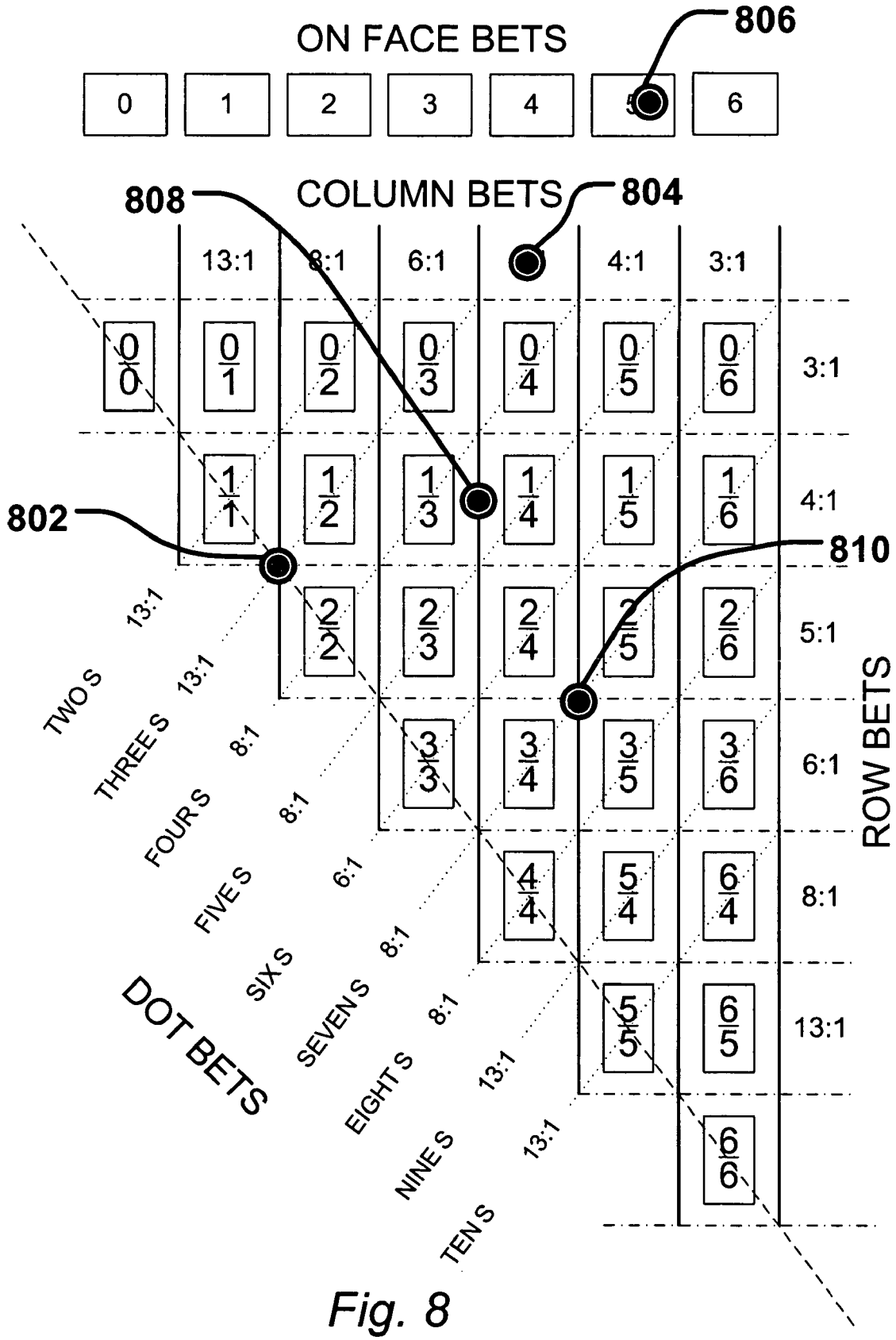
FIG. 8 is an illustration of an exemplary Bet Table for domino games of embodiments of the invention.

FIG. 8 provides another example of a bet table and shows several wager markers or "chips" that indicate individual wagers. For instance wager marker 802 is indicative of a "tri bet" because the marker 802 partially covers three separate dominoes. In an exemplary embodiment, a tri bet wager can only be made on the diagonal edge of the bet matrix because that is the only portion of the bet matrix where a single chip can cover three dominoes. The tri bet can be paid when any of three partially covered dominoes are selected. Here, for instance, the tri bet shown by wager marker 802 would be paid when the next selected domino is any of 1/1, 1/2, or 2/2.

Wager marker 810 is indicative of a "quad bet" because the marker 810 partially covers four separate dominoes. In an exemplary embodiment, a quad bet wager can be made at the intersection of four separate dominoes on the bet table. The quad bet can be paid when any of the four partially covered dominoes are selected. Here, for instance, the quad bet shown by wager marker 810 would be paid when the next selected domino is any of 2/4, 2/5, 3/4, or 3/5.

Wager marker 808 is indicative of an "adjacent bet" because the marker 808 partially covers two adjacent dominoes. In an exemplary embodiment, an adjacent bet wager can be made at the intersection of two adjacent dominoes on the bet table. The adjacent bet can be paid when either of the two partially covered dominoes are selected. Here, for instance, the adjacent bet shown by wager marker 808 would be paid when the next selected domino is any of 1/3 or 1/4.

Wager marker 804 is indicative of a "column bet" because the marker 804 is located within the column bet region. Here, the column bet shown by wager marker 804 would be paid when the next selected domino is any of the dominoes shown in the column below the marker—namely 0/4, 1/4, 2/4, 3/4, or 4/4. Similarly, "row bets" allow wagers that would be paid when the next selected domino of any of the dominoes shown in the row adjacent to a row bet wager marker (not shown). An adjacent column (or row) bet could also be provided that allows a single bet to cover two adjacent columns (or rows).

Wager marker 806 is indicative of an "on face bet" because the marker 806 is located within the on face bet region. Here, the on face bet shown by wager marker 806 would be paid when the next selected domino includes a "5" on its face (i.e., 0/5, 1/5, 2/5, 3/5, 4/5, 5/5, 6/5).

Referring now to FIG. 2, an example of a roulette style wheel that comprises dominoes from a standard 28 domino set is shown. Any suitable means for displaying dominoes, or indications of domino faces, on the wheel can be used to make the roulette style wheel. For instance, the dominoes can be actual domino tiles affixed to the wheel. Alternatively, impressions of dominoes can be imprinted on the wheel, or dominoes can be represented on the wheel (e.g. by pictures, drawings, or paintings of dominoes). The arrangement of dominoes shown in FIG. 2 includes dominoes having pairs of numbers from zero to six. For example, 6/6 represents a domino wherein each half displays six dots, 5/6 represents a domino wherein one half displays five dots and the other half displays six dots. The dominoes shown in FIG. 2 are commonly referred to as a double-six domino set. Any set of dominoes, however, can be arranged on a roulette style wheel for use in the methods disclosed herein, including but not limited to any set with double-seven up to double-eighteen. Alternatively, a standard set plus additional dominoes or a non-standard set of dominoes may be employed. In addition, the actual arrangement of dominoes on the roulette style wheel can vary. Thus, FIG. 2 provides only an exemplary arrangement of a double-six domino set. Additional dominoes or indicators such as non-standard dominoes may be added to the roulette wheel. These may include "0" or "00," for instance.

In domino roulette, a player places a wager by making a bet type according to the bets shown in FIG. 1. The roulette wheel is spun in one direction and a ball is tossed onto the wheel in the other direction. The ball lands on particular domino (i.e. the first domino) on the domino roulette wheel, for example the wheel shown in FIG. 2. A player wins the wager when the ball lands on a domino that matches a domino in the player's wagered bet type. For example, if the player wagered that the first domino (i.e. the revealed domino) would be in the second column of the bet table shown in FIG. 1, and the first domino was a 0/1 or a 1/1, then the player would be paid according to the 13:1 payline.

The term "domino reveal" refers to a game wherein a player places a wager according to the bet types described above and represented in FIG. 1, and wherein the domino is selected, not by a spinning wheel, but by choosing a domino tile and placing into a bet zone. The "bet zone" refers to an area in which the chosen tile is kept prior to the reveal. The "reveal" occurs when the numbers on the tile are revealed to the player or players. A player wins a wager when the domino revealed matches a domino in the player's wagered bet type. For example, if the player wagered that the first domino (i.e. the revealed domino) would be in the second column of the bet table shown in FIG. 1, and the first domino was a 0/1 or a 1/1, then the player would be paid according to the 13:1 payline.

Various methods of choosing the domino tile are provided. For example, a domino tile can be physically selected from a boneyard on a table, a card comprising a picture domino can be drawn from a deck or a pile, or a virtual domino tile can be selected using a computer screen on which the tile is selected by clicking on the desired tile and/or dragging and dropping the tile into a bet zone. The term "boneyard" is used herein to refer to a set of dominoes that are randomly arranged so that the player or players cannot see the number or dots on any of the dominoes in the set. For example, a "boneyard" can be a group of dominoes that are placed face down (i.e. number side is not facing the players) on a surface, such as a table or the ground. The domino tiles in the boneyard are typically shuffled or otherwise randomly mixed up prior to the selection process in which a player or players choose a domino tile.

Once a domino is revealed, it can be placed back into the boneyard, or it can be left out of the boneyard while betting resumes. In the latter embodiment, the odds in the betting matrix are changed according to which domino has been omitted from the boneyard. The latter embodiment can repeated any desired number of times.

In certain embodiments, players of domino reveal may be afforded the option, or may be required, to modify their initial wagers before the game continues. For example, where a revealed domino is omitted from the boneyard and before play resumes, the wagering aspects may be modified by permitting, or requiring, players to increase their wager prior to continuing the game.

In one variation of domino reveal, a player selects a domino before betting (the initial tile). Then, once betting has taken place, and no further bets are allowed, the player is given the option to either reveal the initial tile or swap the tile for another (the review tile). In multiplayer mode, one player can be chosen to select the initial tile (pre betting) and a different player (e.g. clockwise) can be given the option (post betting) to stick with the first player's choice or choose another tile. Once a player chooses not to swap the tile, both the initial tile and the review tile are revealed.

In one embodiment, the domino roulette or domino reveal game can be played by one or more players, in electronic video formats, on personal computer, over a global computer network, or in a live casino table game setting.

In a live casino table game setting, each of one or more players is first afforded an opportunity to place a wager to participate in the game. A wager is made by betting according to the betting matrix shown in FIG. 1. For example, a bet can be made by placing a chip or other marker on a tile, column, or row as shown on the bet table exemplified in FIG. 1. After the first domino is selected, the bets on the table can be removed and/or paid according to the paylines if any player wins a wager, and the game can continue with new wagers being placed.

Figure 4:
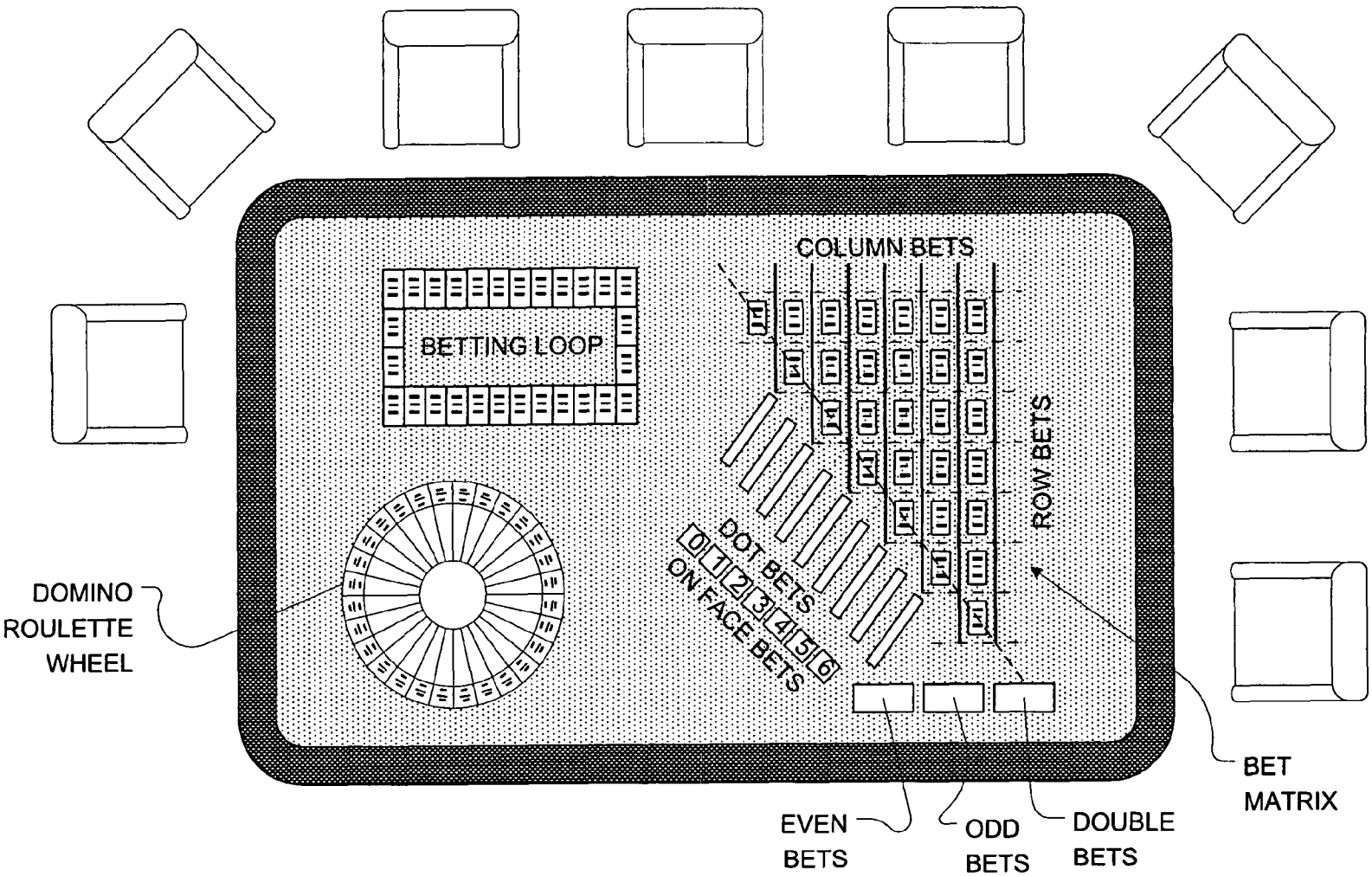
FIG. 4 is an illustration of an exemplary gaming table for Domino Roulette.

FIG. 4 shows an exemplary table for playing Domino Roulette. As shown on FIG. 4, the table comprises several areas for receiving wages, including the bet matrix, the doubles bet box, the odds bet box, the evens bet box, and on face bet boxes. The table also can comprise a domino roulette wheel.

Figure 5:
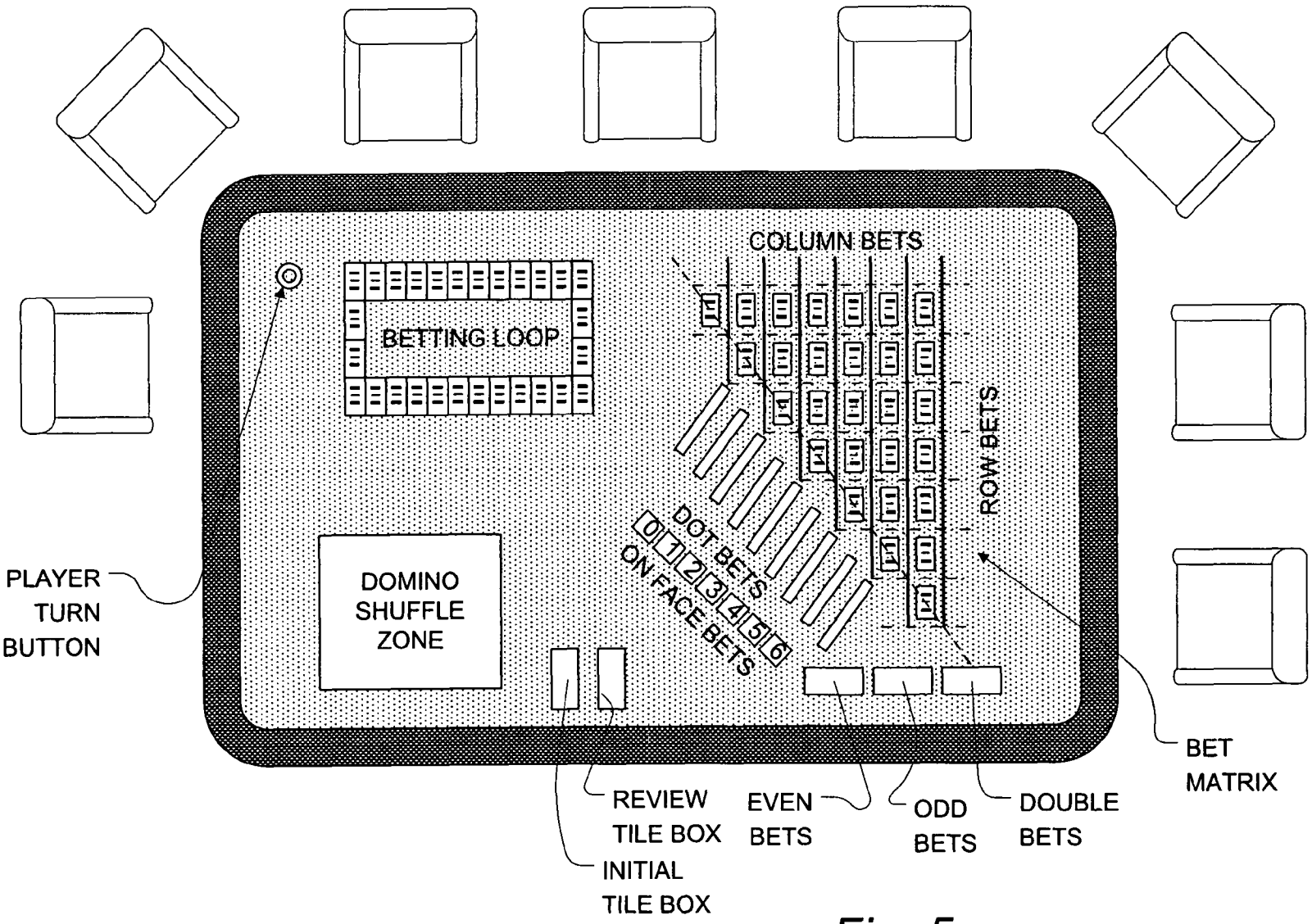
FIG. 5 is an illustration of an exemplary gaming table for Domino Reveal

FIG. 5 shows an exemplary table for playing Domino Reveal. As shown on FIG. 5, the table comprises several areas for receiving wages, including the bet matrix, the doubles bet box, the odds bet box, the evens bet box, and on face bet boxes. The table also can comprise an area for placing of the initial domino tile, and optionally an area for placing the review domino tile. A domino shuffle zone is also shown on in FIG. 5, which comprises the boneyard as described herein or as known in the art. A player turn button can be used to designate a player who is making the selection of an initial tile. The player turn button can be moved, for example, as determined by a dealer.

The embodiments of the domino wagering games disclosed herein are also operable in an electronic gaming machine. It is well known to utilize gaming machines, controlled by processing units, for operating wagering games. The processing unit is typically a computer microprocessor. The gaming machine incorporates a wager accepting means so that a player may place one or more wagers. Once a wager is accepted, a player can choose domino roulette or domino reveal as the means for selecting a first domino. Alternatively, a player can choose domino roulette or domino reveal prior to placing a wager. Alternatively, either domino roulette or domino reveal may be predetermined. A wager can be placed using a bet table (as shown for example in FIG. 1) that is displayed on a gaming machine display unit such as a CRT screen, plasma screen, video screen, etc.

Where domino roulette is chosen, a gaming machine processor causes a virtual domino roulette style wheel to spin and randomly selects a first domino. The virtual domino roulette style wheel (as shown for example in FIG. 2) is displayed on a gaming machine display unit such as a CRT screen, plasma screen, video screen, etc. The first domino is identified, for example, by a virtual ball spinning in the opposite direction as the virtual wheel, and stopping on a particular domino on the wheel. Thereafter, the processing unit causes the first domino to be compared to the player's wager to determine whether a payout is due. If the player wins the wager, the player is paid, for example, in credits or coins.

Where domino reveal is chosen, a gaming machine processor displays a virtual boneyard of dominoes on a gaming machine display unit such as a CRT screen, plasma screen, video screen, etc. The player selects a domino tile from the boneyard by clicking or by clicking, dragging, and dropping the domino tile into the bet zone. The first domino is identified to the player on the gaming machine display unit. The processing unit then causes the first domino to be compared to the player's wager to determine whether a payout is due. If the player wins the wager, the player is paid, for example, in credits or coins. As discussed above, the player can be given the option of swapping the initial tile with a review tile. In multiplayer mode, a second player different from the first player (i.e. the player who selected the initial tile) can be chosen to decide whether or not to swap the initial tile for the review tile.

Domino reveal is particularly well-suited for implementation on a personal computer or over a computer network. For example, a mouse is ideally used to click on, drag, and drop a virtual tile into a bet zone. In addition, where a table starts getting congested from a large number of dominoes, separate "on face" bet buttons can be provided for one, two, three, four, five, six, etc. Alternatively, the processing unit can cause a domino to light up or be otherwise marked when the mouse is hovered over said domino. Where domino reveal is played on a gaming machine, on a personal computer, or over a computer network, the means for being awarded payouts may take the form of a credit being applied to a player's credit card or winnings being mailed to a player. Moreover, a computer mouse or keyboard strokes may provide means for placing the wager.

Figure 6:
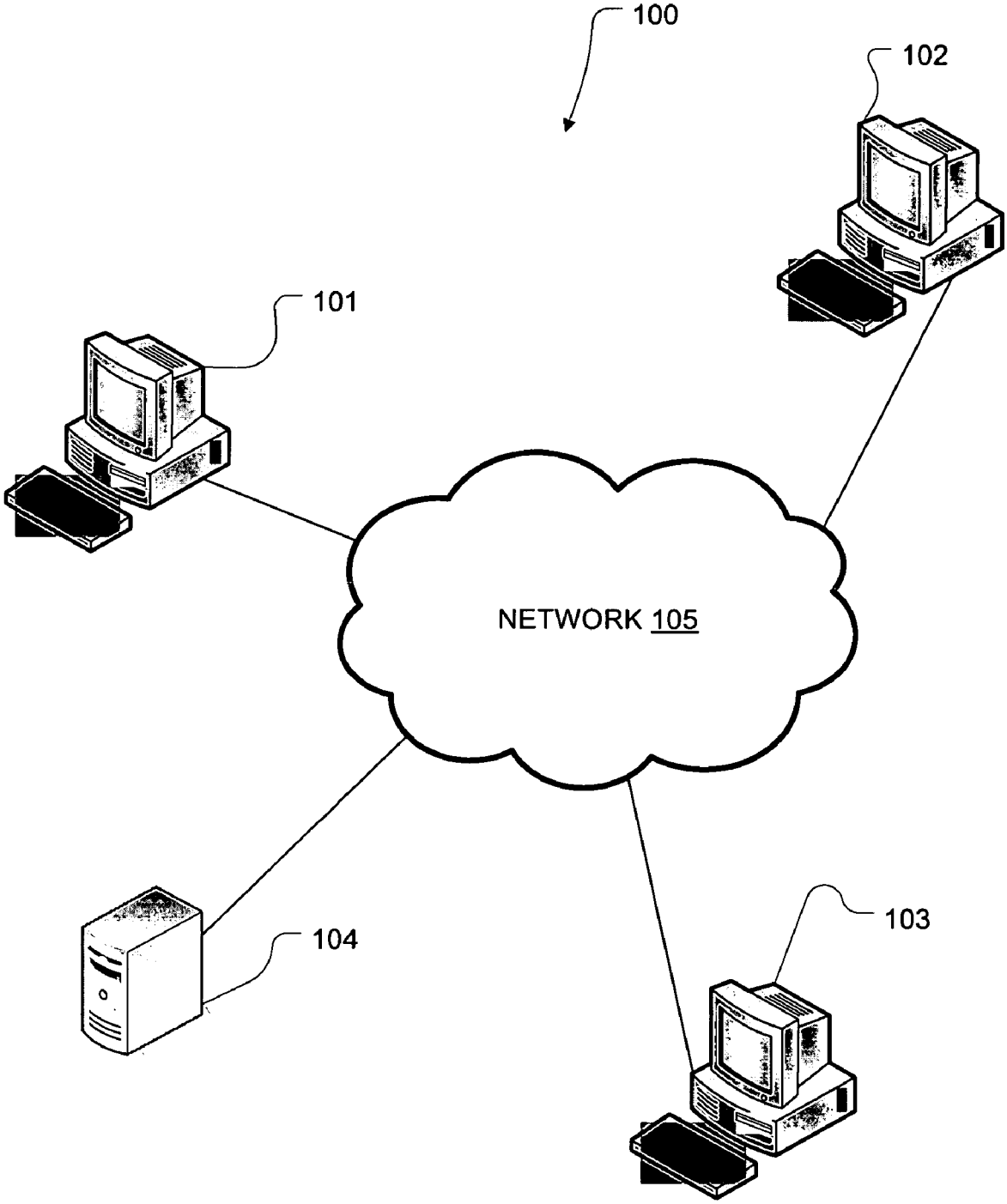
FIG. 6 shows an illustration of a computer network for playing Domino Reveal and/or Domino Roulette.

If either domino roulette or domino reveal are implemented over a computer network, players from different geographic locations may participate. FIG. 6 shows a simple networked gaming configuration 100, which may accommodate multiple players from a variety of locations. Configuration 100 includes computers 101-103, a server 104, and a network 105. The computers 101-103 are in communication with each other and the server 104 via the network 105. Each of the computers 1-3, for example, may include a processor that executes domino game software or allows a player to log into a domino game application running on a remote computer, such as the server 104. The server 104 may include a processor and software that provides a variety of functions which may include, setting up and maintaining a game, inviting players, tracking wagers, receiving electronic payments, and distributing electronic payouts, to name a few. Other networked configurations are possible such as a peer-to-peer network. Further, the network 105 may be a local area network or other network that allows a player to remotely play the domino game.

Published PCT application WO 03/093921 A2 and U.S. Patent Application Publication No. 2006/0079331 disclose systems whereby multiple distributed gaming workstations may engage in gaming activity via a central gaming server over a computer network such as the Internet. The entire contents of WO 03/093921 A2 and 2006/0079331 are incorporated by reference herein.

Figure 7:
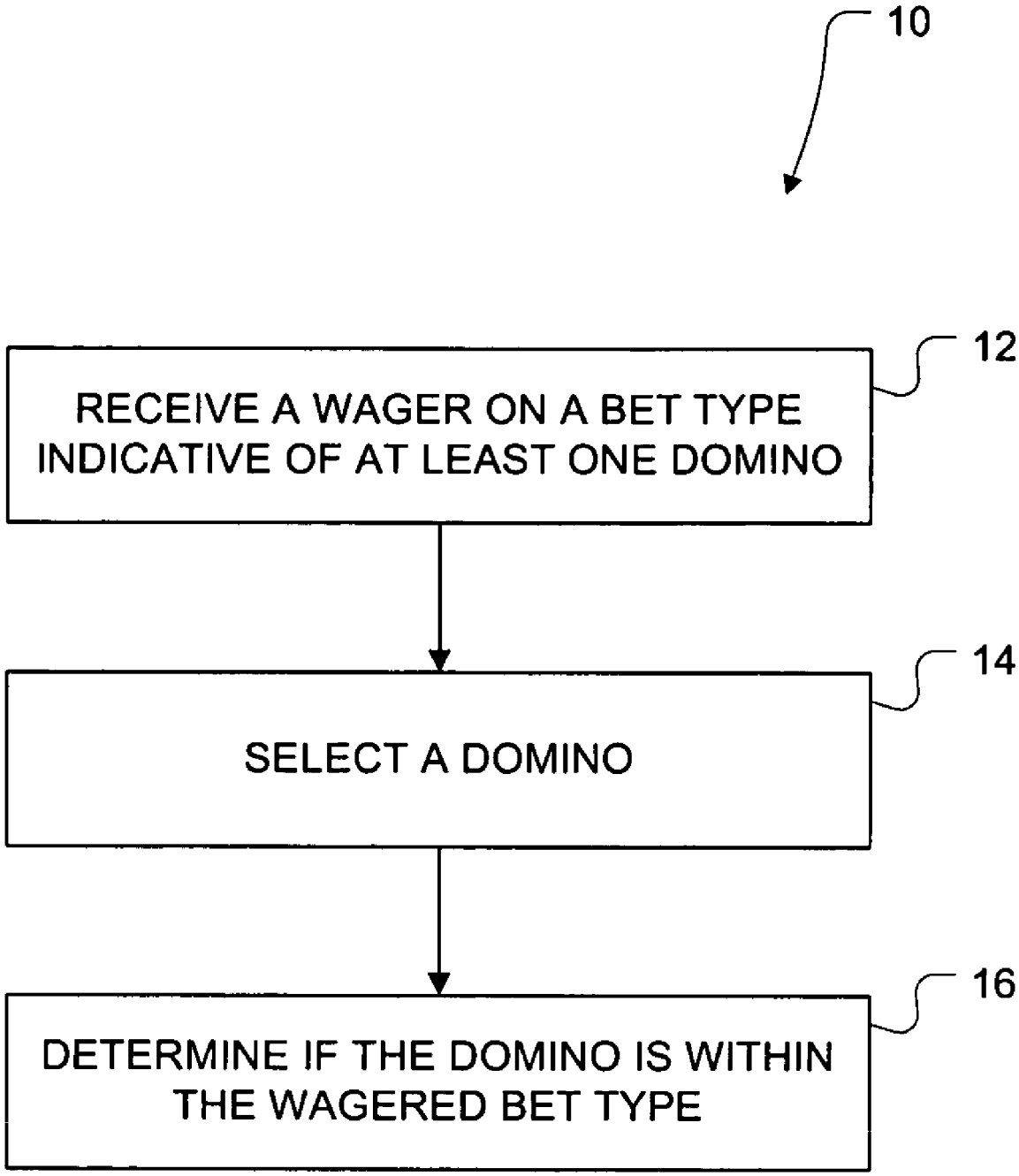
FIG. 7 shows a flow diagram of a method of embodiments of the invention.

FIG. 7 is a flow diagram that shows a method 10 of wagering on at least one domino selected from a group of dominos. At block 12, a participant wagers a bet type indicative of the at least one domino. After the wager, a domino is selected from the group of dominos, shown at block 14. At block 16, a determination is then made as to whether the domino is within the wagered bet type. This flow process may serve as a logical basis for developing a computer implemented gaming system that operates according to the rules of one or more of the domino games.

As described herein, the domino games can use domino tiles, or any other means of presenting dominoes, such as on cards or chips.

Throughout the specification, a number of paylines and payouts are given for various potential wagers. It should be understood that these proposed paylines and payouts are merely exemplary, and other payline and payout schemes may be configured depending upon the desired "house edge" and/or other factors.

As used in this specification and the appended claims, the singular forms "a," "an" and "the" include plural references unless the content clearly dictates otherwise.

It is to be understood that even though numerous characteristics of the present invention have been set forth in the foregoing description, together with an explanation of various possible embodiments and modifications thereto, this disclosure is illustrative only and changes may be made within the spirit of the invention to the full extent indicated by the broad general meaning of the terms in which the appended claims are expressed.

What is claimed is:

1. A method for a gaming server to facilitate play of a domino game by a player at a client machine, wherein the gaming server is communicatively coupled to the client machine, the method comprising the steps of:

the gaming server receiving, from the client machine, a selection of a wager, wherein the wager defines a payout and a bet type, wherein the bet type defines from a plurality of dominoes a set of one or more dominoes that are winning outcomes, wherein a face of each domino comprises two halves, with each half comprising zero or more dots as marking indicia, and wherein the bet type is selected from the group consisting of:

(i) a dot bet, which comprises a selection of a total number of dots on a selected domino;

(ii) a double bet, which comprises a selection of whether an equivalent number of dots appears on both halves of a selected domino; and (iii) an on face bet, which comprises a selection of a specific number of dots appearing on half of a selected domino;

the gaming server choosing the selected domino by spinning a virtual ball on a virtual roulette style wheel, wherein the plurality of dominoes are concentrically arranged on the virtual roulette style wheel, and wherein the selected domino is the domino on which the virtual ball stops;

comparing the selected domino to the winning outcomes defined by the bet type; and the gaming server distributing the payout defined by the wager to the client machine if the selected domino is one of the winning outcomes defined by the bet type, wherein the set of one or more dominoes that are winning outcomes defined by the dot bet comprises at least two dominoes.

2. The method of claim 1, wherein the virtual ball, the virtual roulette style wheel, the spinning of the virtual ball and the virtual roulette style wheel, and the selected domino are displayed through an electronic display unit at the client machine.

3. The method of claim 1, wherein the payout is in credits or coins.

4. The method of claim 1, wherein the method further comprises:

the gaming sever receiving, from the client machine, an additional wager, wherein the additional wager defines an additional payout and an additional bet type, wherein the additional wager is received prior to choosing the selected domino, and wherein the additional bet type defines from the plurality of dominoes an additional set of one or more dominoes that are additional winning outcomes;

the gaming server comparing the selected domino to the additional winning outcomes defined by the additional bet type; and the gaming server distributing the additional payout defined by the additional wager to the client machine if the selected domino is one of the additional winning outcomes defined by the additional bet type.

5. The method of claim 4, wherein the additional bet type is selected from a group consisting of:

a tile bet, which comprises a selection of a particular domino as the selected domino;

an even or an odd bet, which comprises a selection of whether the total number of dots on the selected domino is an even or an odd number, respectively;

a row bet, which comprises a selection of whether the selected domino will fall within a particular row on a bet table, wherein the bet table represents the plurality of dominoes arranged in a matrix with columns and rows, wherein each row and column comprises a consecutively ordered series of dominoes; and a column bet, which comprises a selection of whether the selected domino will fall within a particular column on the bet table.

6. A method for a gaming server to facilitate play of a domino game by a player at a client machine, wherein the gaming server is communicatively coupled to the client machine, the method comprising the steps of:

the gaming server receiving, from the client machine, a selection of a wager, wherein the wager defines a payout and a bet type, wherein the bet type defines from a plurality of dominoes a set of one or more dominoes that are winning outcomes, wherein a face of each domino comprises two halves, with each half using zero or more dots as marking indicia, and wherein the bet type is selected from the group consisting of:

(i) a dot bet, which comprises a selection of a total number of dots on a selected domino;

(ii) a double bet, which comprises a selection of whether an equivalent number of dots appears on both halves of a selected domino; and (iii) an on face bet, which comprises a selection of a specific number of dots appearing on half of a selected domino;

the gaming server receiving from the client machine an indication that the player selected a domino from a virtual boneyard displayed on the client machine, wherein the virtual boneyard comprises the plurality of dominoes laying face down, and wherein the domino selected from the virtual boneyard is the selected domino;

comparing the selected domino to the winning outcomes defined by the bet type; and the gaming server distributing the payout defined by the wager to the client machine if the selected domino is one of the winning outcomes defined by the bet type, wherein the set of one or more dominoes that are winning outcomes defined by the dot bet comprises at least two dominoes.

7. The method of claim 6, wherein the virtual boneyard and the selected domino are displayed through an electronic display unit at the client machine.

8. The method of claim 6, wherein the payout is in credits or coins.

9. The method of claim 6, wherein the method further comprises:

prior to choosing the selected domino, the gaming sever receiving, from the client machine, an additional wager, wherein the additional wager defines an additional payout and an additional bet type, wherein the additional wager is received prior to choosing the selected domino, and wherein the additional bet type defines from the plurality of dominoes an additional set of one or more dominoes that are additional winning outcomes;

the gaming server comparing the selected domino to the additional winning outcomes defined by the additional bet type; and the gaming server distributing the additional payout defined by the additional wager to the client machine if the selected domino is one of the additional winning outcomes defined by the additional bet type.

10. The method of claim 9, wherein the additional bet type is selected from a group consisting of:

a tile bet, wherein the tile bet comprises a selection of a particular domino as the selected domino;

an even or an odd bet, wherein the even or the odd bet comprises a selection of whether the total number of dots on the selected domino is an even or an odd number, respectively;

a row bet, wherein the row bet comprises a selection of whether the selected domino will fall within a particular row on a bet table, wherein the bet table represents the plurality of dominoes arranged in a matrix with columns and rows, wherein each row and column comprises a consecutively ordered series of dominoes; and a column bet, wherein the column bet comprises a selection of whether the selected domino will fall within a particular column on the bet table.

11. A gaming server, communicatively coupled to a client machine, wherein the gaming server allows a player at the client machine to play a domino game, the gaming server comprising:

a communication interface configured to communicate with the client machine;

a processor capable of executing program instructions;

a memory containing the program instructions, wherein the program instructions are executable by the processor to:

receive, from the client machine, a selection of a wager, wherein the wager defines a payout and a bet type, wherein the bet type defines from a plurality of dominoes a set of one or more dominoes that are winning outcomes, wherein a face of each domino comprises two halves, with each half comprising zero or more dots as marking indicia, and wherein the bet type is selected from the group consisting of:

(i) a dot bet, which comprises a selection of a total number of dots on a selected domino;

(ii) a double bet, which comprises a selection of whether an equivalent number of dots appears on both halves of a selected domino; and (iii) an on face bet, which comprises a selection of a specific number of dots appearing on one half of a selected domino;

choose the selected domino;

compare the selected domino to the winning outcomes defined by the bet type; and distribute the payout defined by the wager to the client machine if the selected domino is one of the winning outcomes defined by the bet type, wherein the set of one or more dominoes that are winning outcomes defined by the dot bet comprises at least two dominoes.

12. The gaming system of claim 11, wherein the program instructions further comprises instructions executable by the processor to:

receive, from the client machine, an additional wager, wherein the additional wager defines an additional payout and an additional bet type, wherein the additional wager is received prior to choosing the selected domino, and wherein the additional bet type defines from the plurality of dominoes an additional set of one or more dominoes that are additional winning outcomes;

compare the selected domino to the additional winning outcomes defined by the additional bet type; and distribute the additional payout defined by the additional wager to the client machine if the selected domino is one of the additional winning outcomes defined by the additional bet type.

13. The gaming system of claim 12, wherein the additional bet type is selected from a group consisting of:

a tile bet, wherein the tile bet comprises a selection of a particular domino as the selected domino;

an even or an odd bet, wherein the even or the odd bet comprises a selection of whether the total number of dots on the selected domino is an even or an odd number, respectively;

a row bet, wherein the row bet comprises a selection of whether the selected domino will fall within a particular row on a bet table, wherein the bet table represents the plurality of dominoes arranged in a matrix with columns and rows, wherein each row and column comprises a consecutively ordered series of dominoes; and a column bet, wherein the column bet comprises a selection of whether the selected domino will fall within a particular column on the bet table.

14. The gaming server of claim 11, wherein the program instructions further comprises instructions executable by the processor to choose the selected domino by spinning a virtual ball on a virtual roulette style wheel, wherein the plurality of dominoes are concentrically arranged on the virtual roulette style wheel, and wherein the selected domino is the domino on which the virtual ball stops.

15. The gaming server of claim 14, wherein the virtual ball, the virtual roulette style wheel, the spinning of the virtual ball and the virtual roulette style wheel, and the selected domino are displayed through an electronic display unit at the client machine.

16. The gaming server of claim 11, wherein the program instructions further comprises instructions executable by the processor to choose the selected domino by receiving, from the client machine, an indication that the player selected a domino from a virtual boneyard displayed on the client machine, wherein the virtual boneyard comprises the plurality of dominoes laying face down, and wherein the domino selected from the virtual boneyard is the selected domino.

17. The gaming server of claim 16, wherein the virtual boneyard and the selected domino are displayed through an electronic display unit at the client machine.

18. The gaming server of claim 11, wherein the payout is in credits or coins.

* * * * *